US006461210B2

(12) United States Patent
Lorenzo

(10) Patent No.: US 6,461,210 B2
(45) Date of Patent: Oct. 8, 2002

(54) WAKEBOARD WITH TUBULAR FRAME AND BINDING FOOTPLATE HAVING MULTIDIRECTIONAL ADJUSTABILITY

(76) Inventor: Timoty A. Lorenzo, 148 South G St. #9, Areata, CA (US) 95521

( * ) Notice: Subject to any disclaimer, the term of this patent is extended or adjusted under 35 U.S.C. 154(b) by 0 days.

(21) Appl. No.: 09/799,775

(22) Filed: Mar. 5, 2001

(65) Prior Publication Data

US 2001/0036780 A1 Nov. 1, 2001

Related U.S. Application Data

(60) Provisional application No. 60/187,939, filed on Mar. 3, 2000.

(51) Int. Cl.[7] ..... B63B 1/00
(52) U.S. Cl. ..... 441/68; 441/79
(58) Field of Search ..... 114/39.12–39.19; 441/65, 66, 70, 74, 75, 79

(56) References Cited

U.S. PATENT DOCUMENTS 1,023,601 A * 4/1912 Simpson ..... 441/65
5,396,856 A * 3/1995 Bourrieres ..... 114/39.2
5,853,188 A * 12/1998 Alden ..... 280/627

FOREIGN PATENT DOCUMENTS

WO WO 92/19491 * 11/1992 ..... 114/39.14

* cited by examiner

*Primary Examiner*—Ed Swinehart
(74) *Attorney, Agent, or Firm*—Larry D. Johnson; Craig M. Stainbrook; Johnson & Stainbrook, LLP

(57) ABSTRACT

A wakeboard having a substantially planar plastic base with a top surface and a bottom surface and a lightweight tubular alloy frame fastened at the top surface perimeter. The base is angled slightly proximate each of its ends. The frame is filled with a porous thermoplastic resin. The wakeboard further includes a novel binding system having a foot plate, a footpad, and a strap system. The bindings are secured to the base with mounting bolts having handles or knobs. The foot plate includes arcuate slots at each side of the footpad, each arcuate slot having a several transverse slots. Simple manual loosening of the mounting bolts permits multidirectional adjustment of the binding without the need to remove any part of the binding system from the board.

24 Claims, 4 Drawing Sheets

WAKEBOARD WITH TUBULAR FRAME AND BINDING FOOTPLATE HAVING MULTIDIRECTIONAL ADJUSTABILITY

This application claims benefit of Provisional Application No. 60/187,939 filed Mar. 3, 2000.

BACKGROUND OF THE INVENTION

1. Field of the Invention

The present invention relates generally to wakeboards and their binding systems, and more particularly to a wakeboard having a tubular frame and a binding system having a foot plate that adjusts in several directions without removal from the wakeboard surface.

2. Discussion of Related Art

Sports Boards: Recreational sport boards for use in water include wakeboards, bodyboards, wakeskates, sailboards, surfboards, and the like. The former three kinds are typically pulled behind powered water craft, in the fashion of water skiing.

Wakeboards are generally fabricated from a shaped foam cell core covered with a hard epoxy-resin. This is also typical of sailboard and surfboard construction. An alternative method of construction entails the fabrication of a laminated plank comprising multiple layers of hard wood, polymer, or a combination. Snowboards are similarly constructed. To date, however, no wakeboard design calls for an economical construction comprising fastening a semi-rigid polymer plank to a tubular alloy frame.

A relatively recent development in sports board construction is illustrated in U.S. Pat. No. 5,647,784, to Moran, which discloses a composite bodyboard having a core, an outer covering enclosing the core, and a separation-resistant terpolymeric intermediate layer disposed between and adhesively bonding at least a portion of the core and covering.

An even more recent design is embodied in U.S. Pat. No. 5,934,961 to Mehrmann, et al., which discloses a soft wakeboard having a central torsion box with front and rear fin blocks for fins, and strengthened foam core blocks on either side to provide a form core material. A closed-cell foam top skin layer and a smooth, polymer bottom skin layer are shaped and bonded to the contoured core material. Vertically extending fins are secured to the fin blocks and extend from the bottom skin layer.

A more mature design is found in U.S. Pat. No. 4,850,913 to Szabad, Jr., which teaches a sports board for surfing, snow sledding, and other sports, having a shaped polyethylene foam core to which a polyethylene film/polyethylene foam sheet laminate is heat laminated over substantially all the surfaces of the core.

Binding Systems: Wakeboard binding systems, as well as binding systems adapted for use on snowboards, have evolved rapidly, though not exhaustively, to meet the demand for easy and comprehensive adjustability. Specifically, a great deal of effort has been directed to devising a binding system wherein each foothold can be rapidly and easily adjusted to fit any foot size, and wherein the spread and splay of each binding mount (fore foot and rear foot) can also be easily adjusted. Such full and rapid adjustability would ideally allow users of a wide range of sizes to easily and quickly move and secure the footholds to meet their predilections or needs. The developments, though considerable, have left much room for improvement, particularly where the rapidity and convenience of binding adjustment is concerned.

For example, U.S. Pat. No. 5,910,034 to Vukelic, et al., discloses a wakeboard binding which includes a single piece, adjustable, binding overly of elastomeric sheet material, having a pair of spaced apart extended arms, the binding adapted to secured over the top surface of a heel and toe receptacle which form a boot-like enclosure. The binding includes a cushioned foot pad, and heel and toe receptacles, all of which are mounted on support plates, which are, in turn, securely mounted on a wakeboard. The support plates have a plurality of apertures through which machine screws are threaded to secure the binding to the plates. The support plates enable the user to rotate each binding in a range of degrees and to move the plate forward and back over the width of the wakeboard. However, the user cannot move the bindings rearwardly and forward along the length of the board, and no adjustment can be made without physically removing bolt nuts and entirely separating the binding from the board.

The same limitation applies to the binding system disclosed in U.S. Pat. No. 5,947,781 to VonWald, et al., which advances on the foregoing design by little more than the use of hook-and-loop fasteners for adjusting binding tension.

Two needs remain unmet to this time: First, no sportsboard binding system allows the user to adjust foot position in every direction, including rotationally, without the need to remove the binding from the board; second, no sportsboard employs the economical construction technique of fastening a flexible polymer plank to an alloy frame, and, accordingly, no sportsboard is comprised of only these simple structures with an attached binding system.

SUMMARY OF THE INVENTION

The wakeboard of the present invention provides numerous advantages over known devices. Its lightweight plastic base has a top surface and a bottom surface and a lightweight tubular alloy frame fastened at the top surface perimeter. The base is angled slightly proximate each of its ends. The frame is filled with a porous thermoplastic resin to resist water intrusion into the frame and to increase buoyancy. The frame is connected to the base with lightweight corrosion resistant blind rivets employed through the bottom surface of the base and into the frame. The base includes centered fin boxes near each end in which a first and a second fin are mounted.

The wakeboard further comprises a novel binding system which facilitates easy, multidirectional adjustability. Each binding system comprises a foot plate, a footpad, and a strap system which secures the foot in well known fashion. The foot plate of the binding system includes arcuate slots, each having a plurality of transverse slots generally perpendicular to the arcuate slot. The foot plate is secured to the top of the wakeboard by two bolts having knobs on each side of the footpad. The entire binding may be adjusted simply by loosening the knobs to allow the plate to be rotated, moved forward or rearwardly along the length of the wakeboard, or transversely along the width of the board to center the feet or alter the balance of the user. All of these adjustments may be made without the need to remove any part of the binding system from the board.

DETAILED DESCRIPTION OF THE INVENTION

Figure 1:
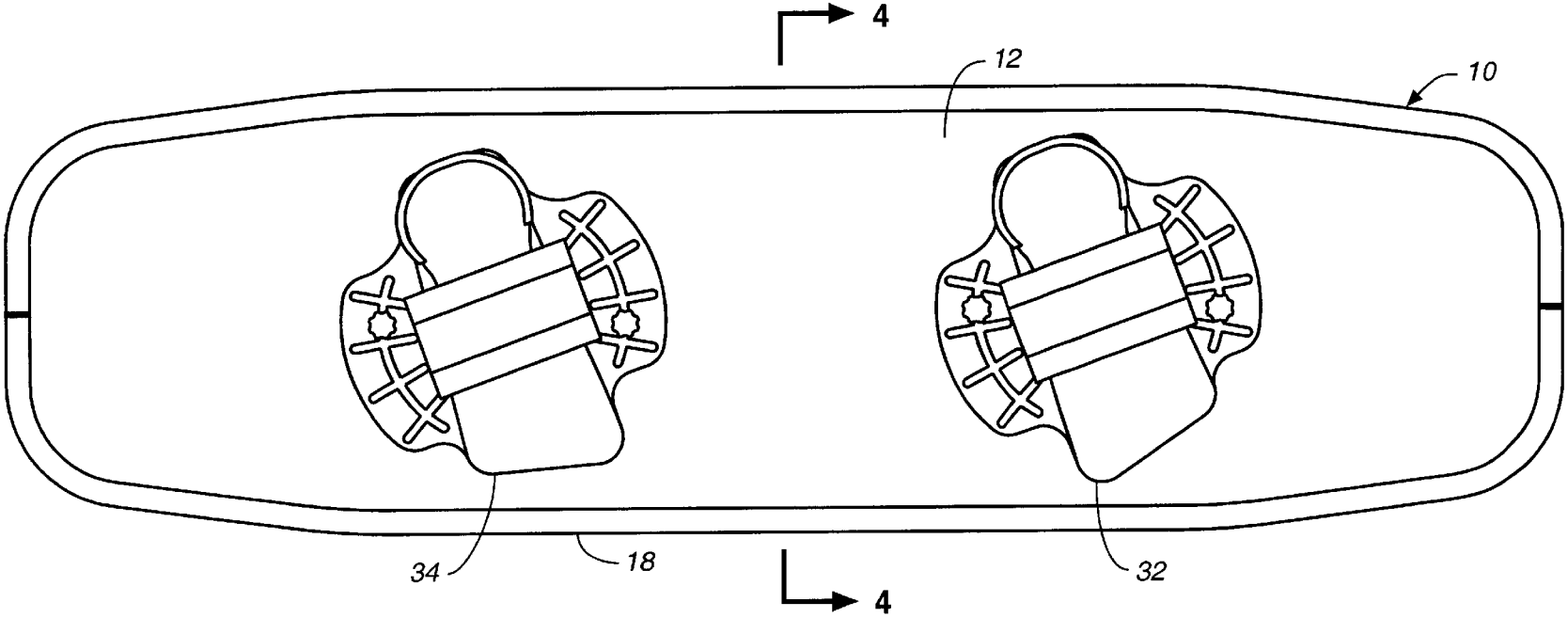
FIG. 1 is a top perspective view of the wakeboard and binding system of the present invention

Referring to FIGS. 1 through 6, wherein like reference numerals refer to like components in the various views, FIGS. 1–4 show that the wakeboard of the present invention, generally denominated 10, comprises an elongate plank member 12, or base, having a top surface 14, and a bottom surface 16, and a hollow tubular frame 18 fastened to the perimeter of the top surface. The frame is preferably fabricated from aluminum or a lightweight aluminum alloy and is preferably filled with a porous thermoplastic resin 19, such as foamed polystyrene, which may be poured into the tube in its plastic state or mechanically pulled into the tube after being suitably sized and shaped. This simple combination alone differentiates the wakeboard of the present invention from the prior art.

The base is preferably fabricated from a semi-rigid polymer, and more preferably a polycarbonate or polyethylene. For aesthetic reasons only it may be desirable that the base be transparent or semi-transparent. This also enables the user to see the water while standing on the wakeboard.

Means for fastening the base to the frame are manifold, though the preferred means comprises lightweight corrosion resistant blind rivets 20 employed through base from its bottom surface, through the top surface, and into the frame member. The frame member is preferably constructed of two pieces 18*a,* 18*b,* joined over a dowel or insert 17 at each end of the frame, then secured by welding, gluing with an epoxy, or joining with fasteners, whichever connection means is most suitable to the material from which the frame is made. Alternatively, the frame may be constructed of a single piece, bent and sized appropriately, and joined at one end in precisely the same fashion as in the two piece construction.

The tubular frame construction provides increased rigidity and structural support during use, when the board is under hydrodynamic forces that would ordinarily tend to bend. and collapse a similarly lightweight board not reinforced with tubular framing. For this reason, the base may be quite thin and light relative to currently existing designs that ordinarily call for construction comprising a thick foam core or heavy materials to prevent structural failure.

Figure 2:
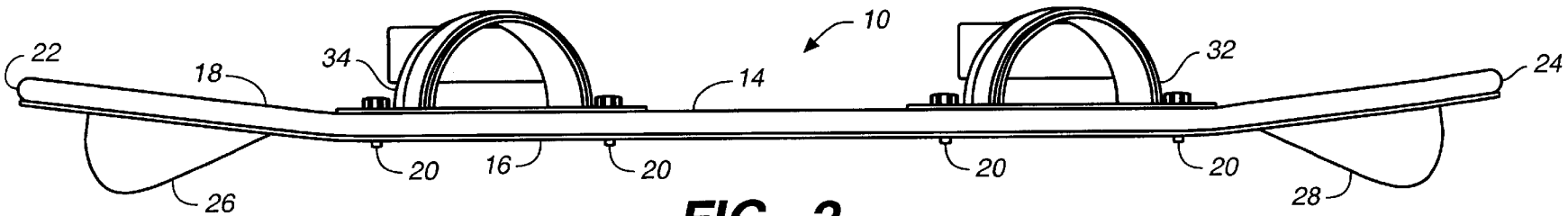
FIG. 2 is a side view in elevation of the wakeboard of FIG. 1.
Figure 3:
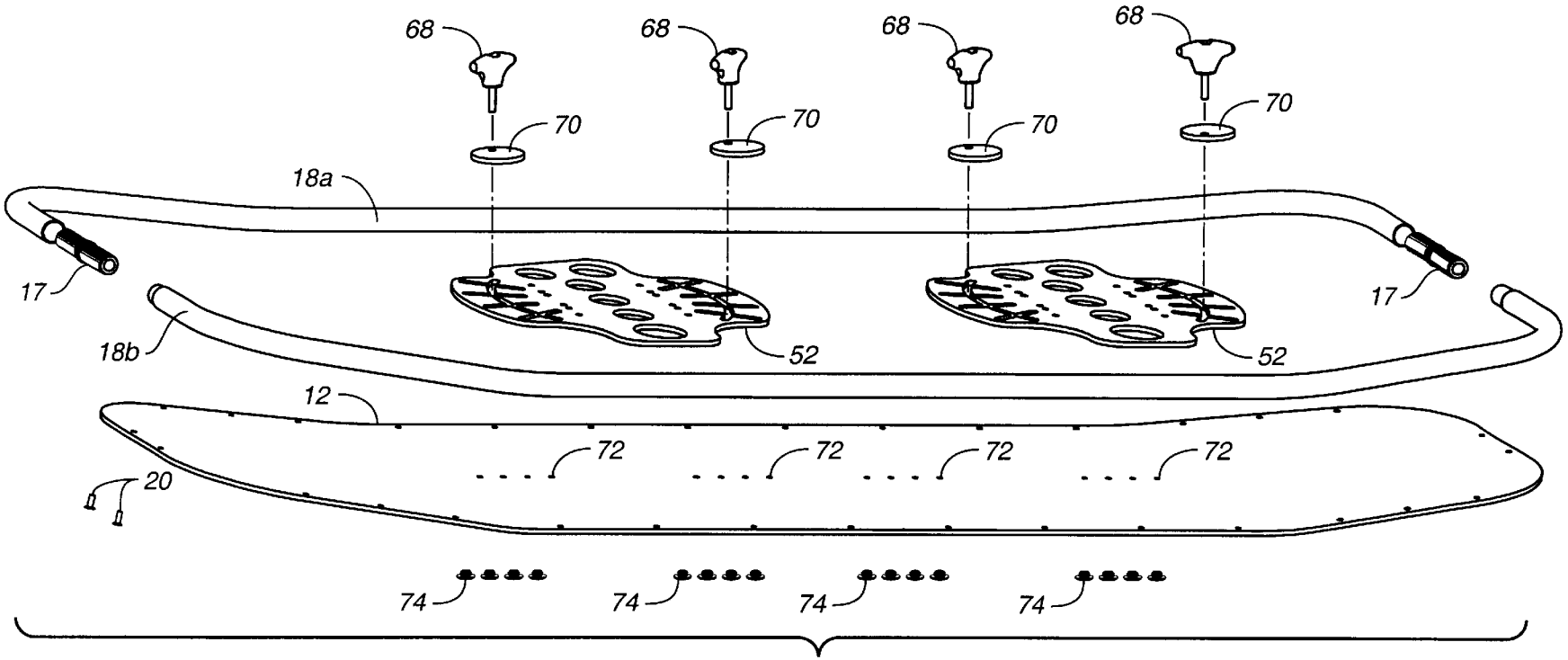
FIG. 3 is an exploded perspective view of the wakeboard of FIGS. 1 and 2 showing the components for assembly.
Figure 4:
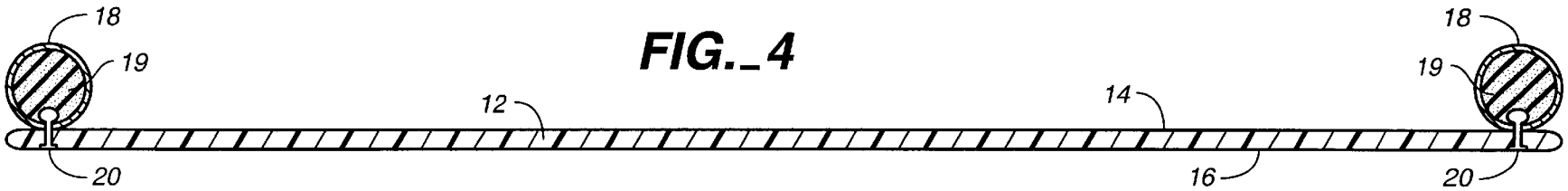
FIG. 4 is a cross-sectional side view in elevation of the inventive wakeboard.

FIGS. 2 and 3 further show that the wakeboard is substantially flat, but generally describes a gently curving profile which bends and angles upwardly proximate its first end 22 and second end 24. The amount and angle of bend depends entirely upon the performance characteristics desired by the end user. The base includes fin boxes (not illustrated) in which a first fin 26 and second fin 28 are mounted, preferably by rivets employed through the respective fins and to the top surface of the board. In a second preferred embodiment, the fins are not positioned within fin boxes but are fastened directly onto the bottom surface of the wakeboard, preferably via two or three quarter inch bolts having 20 course threads per inch.

It will be appreciated that the wakeboard is geometrically and functionally symmetrical relative to its transverse plane (defined by section line 4—4 of FIG. 1) so that during use its direction of movement can be reversed without affecting its maneuverability and stability. The inventive apparatus is therefore well suited to trick and exhibition wakeboarding.

Figure 5:
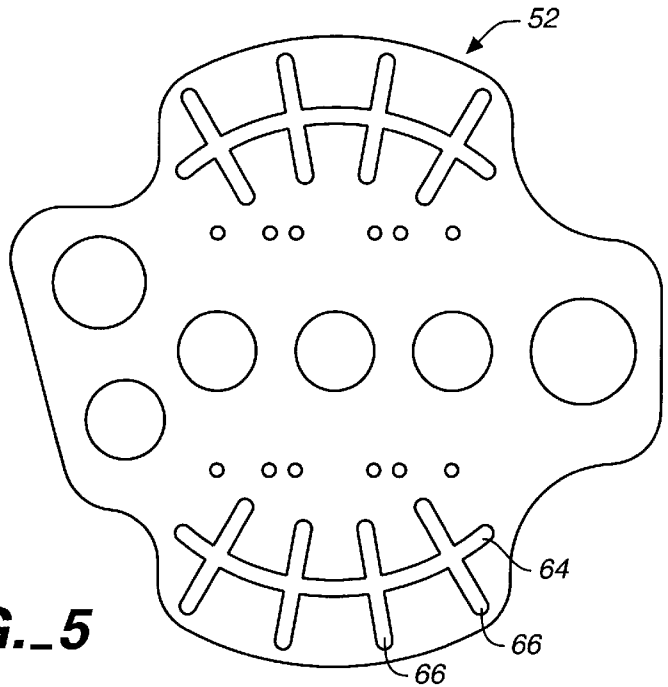
FIG. 5 is a top view of the foot plate and binding system shown in FIGS. 1 and 2.
Figure 6:
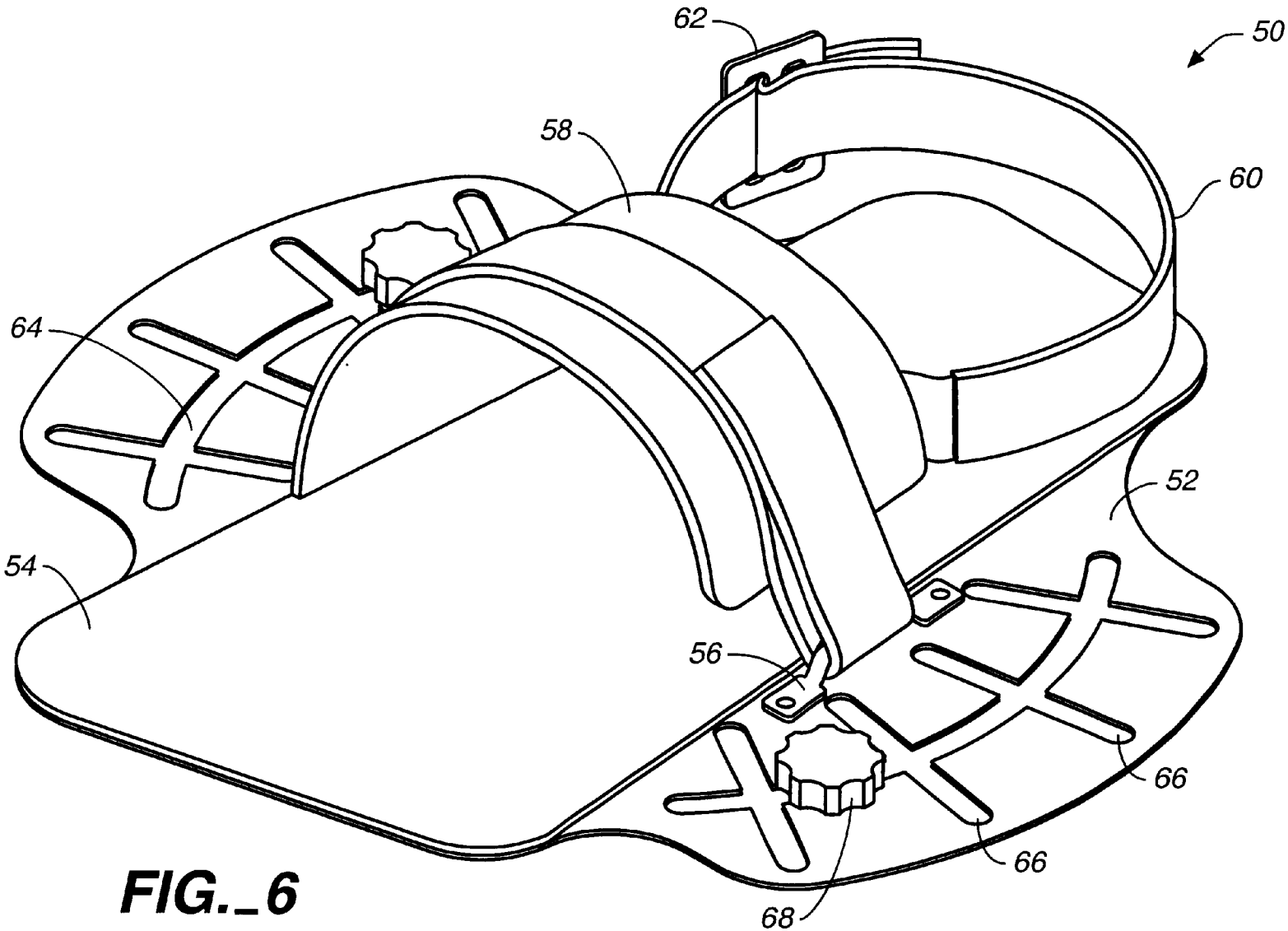
FIG. 6 is a perspective view of the binding system of FIG. 5.

The wakeboard of the present invention further comprises first and second bindings, 32 and 34, respectively. FIG. 5 is a top view of the foot plate and binding assembly, or binding system, 50, and. FIG. 6 is a perspective view showing detail of the binding system. Each binding assembly 50 comprises a foot plate 52, a soft footpad 54 mounted and secured atop said foot plate for positioning the user's foot on the foot plate, and a strap system which secures the foot in a sandallike configuration. These views show that straddling footpad 54 on each of its sides are a first U-bar 56 and a second U-bar (not shown), which are integral with the foot plate and provide a rigid bar for securing the strap system, said strap system comprising an upper strap 58 secured over the top of the user's foot and a heel strap 60. An integral or stitched portion of the upper strap loops through the U-bars on each side of the footpad 54, which portion includes an adjustable length of preferably fabric strap having hook and loop fastener material on its underside for mating with complementary material on the upper side of the upper strap, the assembly providing a means to quickly adjust strap tension. The heel strap is sewn into the upper strap and similarly includes a hook and loop portion and adjustment means, such as a return buckle 62, for quick adjustment of the heel strap tension.

The foot plate of the binding system includes improved means for rapid adjustment of binding position and orientation. On each side of footpad 54 are arcuate slots 64, each of said arcuate slots having a plurality of transverse slots 66 generally perpendicular to the arcuate slot. The foot plate. is secured to the top of the wakeboard by two bolts 68 on each side of the footpad, each bolt having an integral knob or handle. The bolts are inserted first through washers 70, next through the slots in foot plate 52, and then through apertures 72 in base 12, after which they are tightened into threaded and flanged female nuts 74 inserted through apertures 72 from the bottom 16 of base 12. Alternatively, the female nuts may be integrated into the base itself at manufacture and apertures 72 then need not pass entirely through the base. The washers 70 are preferably circular but have eccentric holes to provide maximum adjustability of the foot plate, which need only be loosened to allow the plate to be rotated, moved forward or rearwardly along the length of the wakeboard, or transversely along the width of the board to center the feet or alter the balance of the user. These adjustments can all be made without the need to remove any part of the binding system from the board, and therefore this system represents a substantial improvement on existing systems. The adjustments can even be made in the water without concern over losing parts.

What is claimed as invention is:

1. A foot binding system for use in securing a user's foot to an aquatic recreational device, said binding system comprising:

a foot plate having at least two arcuate slots and a plurality of transverse slots generally perpendicular to said arcuate slots; and a strap system having an upper strap that secures the user's upper foot and a heel strap.

2. The foot binding system of claim 1, further comprising a soft footpad mounted and secured atop said foot plate for positioning the user's foot on the foot plate.

3. The foot binding system of claim 2, further comprising a first and a second U-bar straddling each side of footpad, said U-bars integral with said foot plate and providing a rigid bar for securing said strap system.

4. The foot binding system of claim 1, wherein said upper strap loops through said U-bars, said upper strap including upper strap adjustment means and wherein said heel strap includes heel strap adjustment means.

5. The foot binding system of claim 4, wherein said heel strap adjustment means is a combination return buckle and portion of hook and loop material, and wherein said upper strap adjustment means is a portion of hook and loop fastener material on said upper strap.

6. The foot binding system of claim 1, wherein said foot plate is secured to the top of the aquatic recreational device by two bolts on each side of said footpad, each bolt having an integral handle.

7. A recreational aquatic wakeboard, comprising:

a generally elongate base having first and second ends, a top surface, and a bottom surface, wherein said base substantially planar but includes a gently curving profile that bends and angles upwardly toward said top surface proximate said first end and said second end;

a hollow tubular frame; and means for fastening said frame to said top surface at the perimeter of said top surface.

8. The apparatus of claim 7, wherein said base is fabricated from a thermoplastic polymer.

9. The apparatus of claim 8, wherein said polymer is a polycarbonate.

10. The apparatus of claim 8, wherein said polymer is polyethylene.

11. The apparatus of claim 7, wherein said frame is fabricated from aluminum.

12. The apparatus of claim 7, wherein said frame is filled with a porous thermoplastic resin.

13. The apparatus of claim 12, wherein said thermoplastic resin is foamed polystyrene.

14. The apparatus of claim 7, wherein said frame comprises a single piece.

15. The apparatus of claim 7, wherein said frame comprises two frame halves fastened together by frame fastening means at each end of said frame.

16. The apparatus of claim 15, wherein said frame fastening means comprises a dowel inserted into each of said frame halves and joining said frame halves in cooperation with a permanent adhesive.

17. The apparatus of claim 7, further including at least one fin.

18. The apparatus of claim 7, wherein said apparatus is geometrically and functionally symmetrical relative to its transverse plane.

19. The apparatus of claim 7, further comprising first and second binding assemblies, and means for securing said binding assemblies to said base.

20. The apparatus of claim 19, wherein each of said binding assemblies comprises a foot plate having a footpad and a strap system.

21. A recreational aquatic wakeboard, comprising:

a base having a top surface and a bottom surface;

a hollow tubular frame, wherein said frame is fastened to said base at the perimeter of said top surface by blind rivets employed through said base from said bottom surface, through said top surface, and into said frame.

22. A recreational aquatic wakeboard, comprising:

a base having a top surface and a bottom surface;

a hollow tubular frame;

means for fastening said frame to said top surface at the perimeter of said top surface; and first and second binding assemblies each comprising a foot plate having a footpad and a strap system, and arcuate slots at each side of said footpad, wherein each of said arcuate slots having a plurality of transverse slots generally perpendicular to said arcuate slot; and means for securing said binding assemblies to said base.

23. The apparatus of claim 22, further including a plurality of threaded female nuts integral with said base, and wherein each of said foot plates is secured to said base by two bolts, one at each side of said footpad, each bolt having an integral knob, said bolts inserted first through washers, next through said slots in said foot plate, and then threadably inserted into said female nuts.

24. The apparatus of claim 23, wherein each of said strap systems includes an adjustable upper strap for securing the top of the user's foot, and an adjustable heel strap.

* * * * *